US008573831B2

(12) United States Patent
Celik et al.

(10) Patent No.: US 8,573,831 B2
(45) Date of Patent: Nov. 5, 2013

(54) METHODS AND SYSTEMS FOR MIXING MATERIALS

(75) Inventors: Cem E. Celik, Tonawanda, NY (US); Mark William Ackley, E. Aurora, NY (US); Jeffert John Nowobilski, Orchard Park, NY (US); Salil Uday Rege, Amherst, NY (US)

(73) Assignee: Praxair Technology, Inc., Danbury, CT (US)

( * ) Notice: Subject to any disclaimer, the term of this patent is extended or adjusted under 35 U.S.C. 154(b) by 1262 days.

(21) Appl. No.: 11/799,198

(22) Filed: May 1, 2007

(65) Prior Publication Data

US 2008/0273418 A1 Nov. 6, 2008

(51) Int. Cl.
*B01F 15/02* (2006.01)

(52) U.S. Cl.
USPC ..... 366/348; 366/141; 366/177.1; 366/178.1; 366/181.1

(58) Field of Classification Search
USPC ..... 366/141, 177.1, 181.1, 181.3, 366/183.1–183.3, 178.1, 178.2, 181.5, 348
See application file for complete search history.

(56) References Cited

U.S. PATENT DOCUMENTS

| | | | | |
|---|---|---|---|---|
| 3,300,193 | A | 1/1967 | Badgett | |
| 3,767,170 | A | 10/1973 | Morgenstern | |
| 3,972,686 | A | 8/1976 | Johnson et al. | |
| 4,159,785 | A | 7/1979 | Berry, Jr. | |
| 4,358,207 | A | 11/1982 | Roth | |
| 4,518,262 | A | 5/1985 | Bornemanne et al. | |
| 4,711,645 | A | 12/1987 | Kumar | |
| 4,755,061 | A | 7/1988 | Goins | |
| 5,110,569 | A | 5/1992 | Jain | |
| 5,232,474 | A | 8/1993 | Jain | |
| 5,769,928 | A | 6/1998 | Leavitt | |
| 5,779,767 | A | 7/1998 | Golden et al. | |
| 6,027,548 | A * | 2/2000 | Ackley et al. | 95/96 |
| 6,106,593 | A | 8/2000 | Golden et al. | |
| 6,340,382 | B1 | 1/2002 | Baksh et al. | |
| 6,358,302 | B1 | 3/2002 | Deng et al. | |
| 6,638,340 | B1 | 10/2003 | Kanazirev et al. | |
| 6,719,827 | B2 | 4/2004 | Golden et al. | |
| 7,264,651 | B2 | 9/2007 | Henzler et al. | |
| 7,455,718 | B2 | 11/2008 | Ackley et al. | |
| 7,713,333 | B2 | 5/2010 | Rege et al. | |
| 7,722,702 | B2 | 5/2010 | Ackley | |

FOREIGN PATENT DOCUMENTS

| | | |
|---|---|---|
| DE | 1233760 | 2/1967 |
| DE | 3045451 A1 | 7/1981 |
| DE | 3702190 A1 | 8/1988 |
| EP | 0 904 825 A2 | 3/1999 |
| WO | WO98/34737 | 8/1998 |
| WO | WO 2005014251 A1 * | 2/2005 |

OTHER PUBLICATIONS

Chihara et al., "Simulation of Nonisothermal Pressure Swing Adsorption", Journal of Chemical Engineering of Japan (1983), pp. 53-61.

(Continued)

*Primary Examiner* — Walter D Griffin
*Assistant Examiner* — Timothy Cleveland
(74) *Attorney, Agent, or Firm* — Salvatore P. Pace

(57) ABSTRACT

The present invention relates generally to methods and systems for mixing at least two different solid materials (e.g., adsorbents) and loading the mixture into a vessel, such as an adsorption vessel or reactor.

28 Claims, 6 Drawing Sheets

(56) References Cited

OTHER PUBLICATIONS

Kotoh et al., "A Multilayer Model for Adsorption of Water on Activated Alumina in Relation to Adsorption Potential", Journal of Chemical Engineering of Japan (1993), vol. 26, No. 4, pp. 355-360.

Rege et al., "Air-prepurification by Pressure Swing Adsorption Using Single/Layered Beds", Chemical Engineering Science (2001), vol. 8, pp. 2745-2759.

* cited by examiner

METHODS AND SYSTEMS FOR MIXING MATERIALS

TECHNICAL FIELD

The present invention relates generally to methods and systems for mixing at least two different solid materials (e.g., adsorbents) and loading the mixture into a vessel, such as an adsorption vessel or reactor.

BACKGROUND OF THE INVENTION

In the area of adsorption technologies such as pressure swing adsorption (PSA), temperature swing adsorption (TSA), vacuum pressure swing adsorption (VPSA) and combinations thereof, there are circumstances where a mixture of different adsorbents can provide advantages over the use of adsorbents in discrete layers. For example, it can sometimes be advantageous to use a mixture of different adsorbents rather than discrete layers of the same adsorbents to reduce exothermal heating during adsorption, to reduce adsorbent inventory and/or cost, to decrease sensitivity to limitations in achieving a precise layer depth and the like.

Blending or mixing of materials may be accomplished at the time of manufacture or during loading of the adsorbent vessels. While blending at time of manufacture removes a field operation, an additional unit operation is added in production that may introduce moisture. In addition, the materials may settle or otherwise segregate during shipping. Premixed materials with different properties may moreover segregate during loading into the vessel.

Mixing materials during field vessel loading can require specially designed loading equipment and trained personnel to perform the operation. Prior art techniques for mixing adsorbents in the field have included the possibility of particle segregation in the mixture right after mixing the materials. Such segregations may be induced by differences in shape, size and/or density of particles to be mixed. Segregation of particles is more likely if there is a motion of the mixture.

It would be desirable to provide methods and systems for loading mixtures of materials into a vessel which can be economical to design and manufacture and which facilitates ease of operation.

BRIEF SUMMARY OF THE INVENTION

The present invention relates generally to methods and systems for mixing at least two different solid materials and loading the mixture into a vessel, such as an adsorption vessel or reactor. Solid materials for the purpose of this invention may include adsorbents, catalysts, inert materials and/or combinations thereof. While not to be construed as limiting, representative or exemplary adsorbents suitable for mixing in accordance with the present invention may include the classes of materials defined by zeolites, activated alumina, activated carbon, silica gel, etc. Catalysts may be from the class of materials represented by supported and unsupported catalyst. Inert materials include, but are not limited to, non-porous solids (such as glass beads, ceramics, etc.) and porous materials such as adsorbents or catalysts which are inert with respect to the fluids being treated.

The materials to be mixed and used in accordance with the present invention can be in the form of particles (e.g., free flowing particles). Particles may be in the form of beads, extrudates, granules or the like.

"Different" materials means solid materials with either one or more different physical characteristic(s) (e.g. particle size, density, shape, chemical composition, etc.) or different adsorptive or catalytic characteristics.

The methods and systems of the present invention allow for mixing of at least two materials in a manner that can promote homogeneity in the mixture. The methods and systems of the present invention can also reduce or minimize exposure to moisture and the possibility of segregation during loading.

A mixture in accordance with the present invention is one in which the mixture as discharged from the main funnel is a predetermined composition, determined on a volumetric or weight basis. A homogeneous mixture is one in which the variation in the composition of each component is less than about ±10% determined on a volumetric basis (which can be converted to a weight basis). Preferably, the composition does not vary more than 5-7 volume % and more preferably, the composition does not vary more than 1 volume %.

The present invention more specifically relates to the use of a plurality of storage bins, with each bin housing at least one material to be mixed (e.g., adsorbent). The bins are configured such that in use, each adsorbent can be discharged from the respective hopper at the bottom of the bin onto a main funnel. The main funnel is positioned at an entrance to a vessel for loading the adsorbent mixture into the vessel.

In accordance with the present invention, the adsorbent is discharged from its respective hopper and then impacts and bounces or rebounds off the inner surface of the funnel towards the center axis of the funnel. The at least one other material (e.g., adsorbent(s)) from the at least one other hopper(s) is likewise discharged from its respective hopper and then impacts and bounces or rebounds off the inner surface of the funnel towards the center axis of the funnel. The adsorbent particles from one hopper randomly mix with the adsorbent particles from the other hopper(s) to form a homogeneous mixture. The blended mixture of adsorbents then chutes down from the main funnel opening into the process vessel. The volume percentage of each adsorbent material in the mixture is controlled by the flow area of the respective discharge hopper. The flow areas of the discharge hoppers can be regulated by slide-gates, iris valves, other particle control valves or combinations thereof (e.g., a shutoff valve and a control valve on the same hopper).

The present invention thus utilizes gravity to assist in the flow of the materials (e.g., adsorbents) to achieve a homogeneous mixture, with the volumetric flow rates being regulated by slide-gates, iris valves, other particle control valves or combinations thereof. While the gates/valves used in accordance with the present invention can be moved or adjusted, the mixer does not utilize moving parts for mixing or blending the materials. In addition, the mixers of the present invention can be designed and manufactured in an economic manner.

In some embodiments, the desired composition is uniform and can be controlled within a small tolerance range (e.g., the composition varies only by about 1% or less by volume (which can be converted to a weight basis)).

In some embodiments of the present invention, the volume of each adsorbent in the mixture can be varied during continuous operation of the mixer. More specifically, the adsorbent mixture composition according to this embodiment of the invention can be varied in any predetermined amount as a function of the desired bed height in the vessel. Such embodiments may be advantageous for example in situations where it is desirable to vary the adsorbent mixture composition along the length of the adsorbent bed.

In accordance with such embodiments of the present invention, the bins/hoppers are equipped with one or more load cells to measure the weight of the bin, hopper and material therein. Valves (e.g., slide valves, control valves, or iris valves that can be used to control the flow of particles) are to be controlled and varied during operation of the mixer to achieve the desired mixture of materials. The valves can optionally be controlled by using a microprocessor (for example, a program logic controller (PLC) or process computer) to monitor load cells and control discharge valves. The PLC or computer can thus be connected to one or more load cell(s) on each discharge bin/hopper. For example and while not to be construed as limiting, the PLC or computer can be connected to three load cells per hopper. Alternatively, the PLC or computer can be connected to one load cell per hopper if the hopper is suspended from the load cell. In other alternative embodiments, the discharge valves may be controlled manually based on the computer display. The PLC or computer can be programmed to control or respond to load cell measurement(s). For example, the PLC or computer can be programmed to determine the change in weight of the material in the hoppers using feedback (continuous or intermittent) from the load cells that measure the weight of the bin, hopper and weight of the material therein. In response to such feedback, the particle valves (e.g., iris valves) can be opened or closed to respectively increase or decrease the volume of adsorbent being discharged from the respective discharge hopper. In this manner, a continuous variable mixture of materials (e.g., adsorbents) over the height of the material (e.g., adsorbent) bed in the vessel can be provided if desired. Such embodiments can also be used to form discrete uniform layers of mixtures of materials in the vessel.

In accordance with the present invention, the risk of segregation of mixed particles can be reduced or minimized and thus keep the mixture homogenous during loading into the vessel. Mixing the materials (e.g., adsorbents) during the field loading can thus have technical advantages over pre-mixing of the materials during manufacture. Pre-mixed materials are prone to segregation during transportation and subsequent loading. As mentioned hereinabove, the pre-mixing process during manufacturing may also increase the chance of materials being exposed to moisture.

BRIEF DESCRIPTION OF THE DRAWINGS

For a more complete understanding of the present invention and the advantages thereof, reference is made to the following Detailed Description taken in conjunction with the accompanying drawings in which.

DETAILED DESCRIPTION

Figure 1:
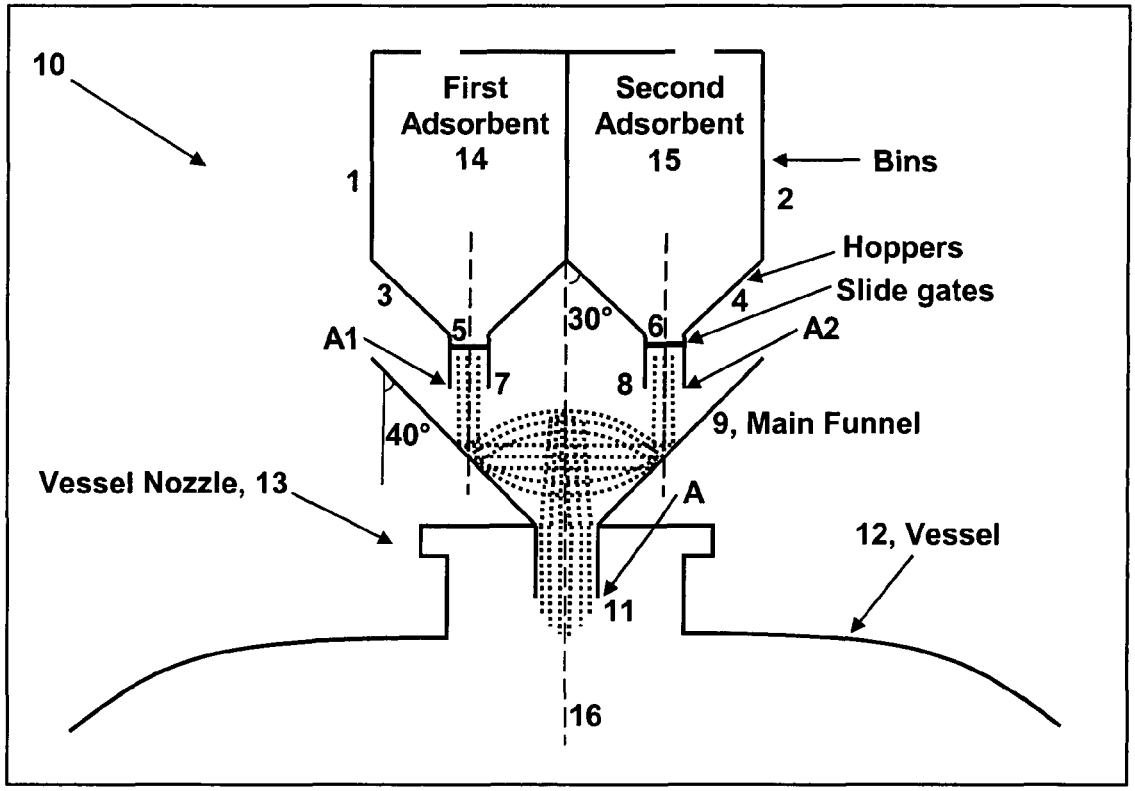
FIG. 1 illustrates an embodiment of a mixer in accordance with the present invention.

As mentioned above, the present invention relates generally to methods and systems for mixing at least two different solid materials and loading the mixture into a vessel, such as an adsorption vessel or reactor. Solid materials for the purpose of this invention may include adsorbents, catalysts, inert materials and/or combinations thereof. While not to be construed as limiting, representative or exemplary adsorbents suitable for mixing in accordance with the present invention may include the classes of materials defined by zeolites, activated alumina, activated carbon, silica gel, etc. Catalysts may be from the class of materials represented by supported and unsupported catalyst. Inert materials include, but are not limited to, non-porous solids (such as glass beads, ceramics, etc.) and porous materials such as adsorbents or catalysts which are inert with respect to the fluids being treated or used in the process vessel.

The materials to be mixed and used in accordance with the present invention can be in the form of particles (e.g., free flowing particles). Particles may be in the form of beads, extrudates, granules or the like.

"Different" materials means solid materials with either one or more different physical characteristic(s) (e.g. particle size, density, shape, chemical composition, etc.) or different adsorptive or catalytic characteristics.

The methods and systems of the present invention allow for mixing of at least two materials in a manner that can promote homogeneity in the mixture. The methods and systems of the present invention can also reduce or minimize exposure to moisture and the possibility of segregation during loading.

A mixture in accordance with the present invention is one in which the mixture as discharged from the main funnel is a predetermined composition, determined on a volumetric or weight basis. A homogeneous mixture is one in which the variation in the composition of each component is less than about ±10% determined on a volumetric basis (which can be converted to a weight basis). Preferably, the composition does not vary more than 5-7 volume % and more preferably, the composition does not vary more than 1 volume %.

The present invention more specifically relates to the use of a plurality of storage bins, with each bin housing at least one material to be mixed (e.g., adsorbent). The bins are configured such that in use, each adsorbent can be discharged from the respective hopper at the bottom of the respective bin onto a main funnel. The main funnel is positioned at an entrance to a vessel for loading the adsorbent mixture into the vessel.

The adsorbent is discharged from its respective hopper and then impacts and bounces or rebounds off the inner surface of the funnel towards the center axis of the funnel. The at least one other material (e.g., adsorbent(s)) from the at least one other hopper(s) is likewise discharged from its respective hopper and then impacts and bounces or rebounds off the inner surface of the funnel towards the center axis of the funnel. The adsorbent particles from one hopper randomly mix with the adsorbent particles from the other hopper to form a homogeneous mixture.

The blended mixture of adsorbents then chutes down from the main funnel opening into the process vessel. The volume percentage of each adsorbent material in the mixture is controlled by the flow area of the respective discharge hopper. The flow areas of the discharge hoppers can be regulated by slide-gates, iris valves, other particle control valves or combinations thereof (e.g., a shutoff valve and a control valve on the same hopper).

In an embodiment of the present invention, gravity is used to assist in the flow of the materials (e.g., adsorbents) to achieve a homogeneous mixture, with the volumetric flow rates being regulated by slide-gates. While the gates/valves used in accordance with the present invention can be moved or adjusted, the mixer does not utilize moving parts for mixing or blending the materials. In addition, the mixers of the present invention can be designed and manufactured in an economic manner.

Referring now to FIG. 1, a mixer 10 in accordance with an embodiment of the present invention is illustrated. Mixer 10 includes at least two different bins 1, 2 and a main funnel 9. Bins 1, 2 can each be formed as a cylindrical volume and configured to contain the respective materials (e.g., first adsorbent material 14 and second adsorbent material 15) to be mixed with one another. Each bin respectively includes hopper 3, 4 as shown in FIG. 1. Hoppers 3, 4 may be conical-shaped funnels attached at the bottom of the respective bin or formed as an integral part of the respective bin.

Materials of construction for the bins, hoppers and funnel include plastic or steel (e.g., stainless steel). Such material, however, is illustrative and not limiting. Other materials of construction can be used according to the present invention. Preferred materials of construction are resistant to corrosion and have a smooth surface to reduce friction. The material(s) of construction are selected such that friction between the surface of the hopper material (whether the surface is coated or not) and the particles is low (i.e., the surface of the construction material should be smooth enough so as not to degrade or cause flow blockage of the particles).

As further shown in FIG. 1, the discharge of main funnel 9 is positioned proximate to the vessel nozzle 13 of vessel 12. In preferred embodiments, the opening 11 from funnel 9 extends into vessel 12 as illustrated in FIG. 1 in order to prevent exposing the particles in the mixture to ambient moisture.

Hoppers 3, 4 have respective discharge openings 7, 8 with slide-gates or slide valves 5, 6 positioned proximate to the bottom of the hoppers 3, 4, respectively. Discharge opening 7 has an area A1 while discharge opening 8 has an area A2. Main funnel 9 includes a center axis 16, discharge opening 11 defining an area A.

In use, bin 1 contains a first adsorbent or material 14 while bin 2 contains a second adsorbent or material 15 different from the first adsorbent or material. The present invention can be used to mix any types of adsorbents. For example and while not to be construed as limiting, the mixer 10 can be used to form mixtures of AgX adsorbent and 13X APG adsorbent such as described in published PCT international publication number WO 2007/005399 A1, published on Jan. 11, 2007. See also, published PCT international publication number WO 2007/005398 A2, published on Jan. 11, 2007.

The first and second adsorbents 14, 15 can be discharged respectively from bins 1, 2 into funnel 9, and mixed together to form a homogeneous mixture. More specifically, adsorbents 14, 15 pass through respective hoppers 3, 4 onto the inner surface of main funnel 9, which is positioned on top of the vessel nozzle 13.

Slide-gates or slide valves 5, 6 are positioned at the bottom of the each respective hopper 3, 4 as shown in FIG. 1. The gates regulate the volumetric flow rates of the materials from the respective bins and hoppers. Simultaneous opening of both slide-gates initiates flow of materials 14, 15 out of both bins 1, 2 and to hoppers 3, 4 to form the desired mixture.

In one exemplary embodiment, the slide-gates can be fully opened where the flow characteristics of the adsorbents are about equal and the discharge areas of the hoppers are equal to form a homogeneous 50%-50% (by volume) mixture of the first and second adsorbents. When the slide-gates are fully open, the flow areas at the respective hopper discharges or openings 7, 8 determine the volumetric flow rate of each material. In some alternative embodiments, however, one or both of slide-gates 5, 6 can be partially opened (or throttled) to alter the volumetric flow rate to achieve a mixture with volume percentages other than 50%-50%. If one or both of the slide-gates is partially open, the size of the flow area formed by the partial opening at the slide-gate rather than hopper discharge opening determines the volumetric flow rate out of that bin.

The particular configuration of the mixer and the materials to be mixed determine the desired amount that the slide-gates are to be opened. More particularly and in the above example, discharging equal volumetric flow rates of each material from the two bins thus allows 50%-50% volume percentage of each material in the mixture to be formed. Equal volumetric flow rates can be achieved for the materials by considering their shapes, sizes, and densities and establishing the desired sizes of flow areas at the discharge of each hopper. In general, however, the flow areas at the hopper discharges do not have to be equal to achieve identical volumetric flow rates. The volumetric flow rate of a material through an opening of a given size depends upon the physical properties of the material, such as size, shape, density, etc. As an example of measuring flow rates of different materials (e.g., shape, size or other property) from a fixed size opening, a given sample volume of material can be run through the certain opening size and the elapsed time for full discharge can be measured to determine the volumetric flow rate of a material for a given opening size. While the flow discharge areas 7 and 8 in this example are equal because the exemplary materials discussed flow at about the same rate, it can be appreciated that a different shape or size material can flow at a different rate.

Volume percentages other than a 50%-50% in the mixture can be achieved by altering the volumetric flow rate of one or more materials out of the hopper(s) to the desired volumetric percentages in the mixture. Partial opening of slide-gates 5, 6 can assist to regulate the volumetric flow rates being discharged out of each bin. Alternatively, the areas A1 and A2 of the respective discharge openings 7, 8 can be designed during manufacture for the desired flow of areas A1 and A2 for the materials to be used.

As further shown in FIG. 1, the discharged materials (e.g., adsorbents) 14, 15 impact the inner surface of the main funnel 9 and then bounce or rebound towards the center axis of the main funnel 9 to randomly mix with each other to form a homogeneous mixture of the two materials (e.g., adsorbents). As further shown in FIG. 1, the blended mixture of materials (e.g., adsorbents) then chutes down from the main funnel opening 11 into the process vessel 12.

The bed of mixed material in the vessel can be formed by leveling the accumulated material inside the vessel. Alternatively, distribution means can be located at the discharge of main funnel 11 to load the mixture into the vessel. Exemplary distribution means include, but are not limited to, a continuously or intermittently rotating loading arm(s), one or more continuous or intermittent chute(s), one or more screens, rotary discs and spreaders.

Generally, the discharge area of the main funnel should be greater than the sum of the discharge areas of both hoppers 7, 8, in order to reduce or eliminate any chance of the mixture accumulating in the main funnel which could compromise the mixing process or plug the discharge 11. In some embodiments, the discharge area A of the main funnel is twice the combined areas of the hoppers, (A=2(A1+A2)).

The center axis of each hopper opening should be located at equal distances and at symmetric angles (e.g., 180° for two hoppers and 120° for three hoppers) around the center line or axis of the main funnel. In addition, the discharges from the hopper openings should not overlap with the discharge from the main funnel opening. For example and with reference to FIG. 1 where the cross-sectional areas A, A1 and A2 are circular, the distances between the centerlines of the hopper openings and the centerline or axis of the main funnel should be equal to or larger than the diameter of the main funnel discharge opening. The center axis of each hopper opening should be located equal distances away from the centerline or axis 16 of the main funnel 9 to ensure that the impact of the materials occur in a symmetrical manner. These hopper projections should be at least a diameter of the main funnel opening away from the main funnel opening to give the bouncing materials sufficient space for mixing and to prevent short-circuiting (i.e. no impact within the diameter of the main funnel) of materials (e.g., adsorbents).

On the other hand, if the hopper discharges or openings 7, 8 are constructed too far away from each other, the materials could be prevented from mixing upon bouncing or rebounding off of the inner surface of the main funnel 9. In such case, the materials would chute down the inner surface of the main funnel without mixing or adequate mixing. Symmetrical impact position with enough space for mixing and even flow out of each hopper ensures homogeneous mixture.

In an embodiment where the desired percentage of each material in the mixture is 50% by volume and with fully opened slide-gates and where the flow characteristics are similar, flow areas of A1 and A2 at each hopper discharge 7, 8 provide equal flow rates of the first adsorbent and the second adsorbent to achieve the desired mixture.

While not to be construed as limiting and in one embodiment of the invention, the openings at the hopper discharges 7, 8 are circular, the materials have similar flow characteristics and each hopper has a 2-inch inner diameter (ID) opening. This opening size provides the same volumetric flow rates for the first and second adsorbent materials. In this manner, the mixture can contain 50% by volume of each adsorbent material. To ensure uninterrupted flow of the mixture in such an embodiment, a 4-inch inner diameter (ID) circular opening for the main funnel discharge 11 is provided.

In situations where other mixture percentages are desired, the flow areas at the hopper discharges 7, 8 can be modified (by redesigning the discharge area) to provide desired volumetric flow rate, and the desired volume percentage of the mixture. The flow area of discharge area 11 can then be modified.

Homogeneous mixtures in accordance with the invention are achieved with uninterrupted and continuous flow of materials out of both hoppers 7, 8 and main funnel 9. Continuous and uninterrupted flow is achieved when the hoppers are discharging materials in "mass flow" regime, a condition in which all the materials in the hoppers are moving downward continuously. Steep hopper angles and low friction between the particles and the smooth walls of the inner surface of the hoppers ensures mass flow.

Hopper angles, as measured from vertical, for both hoppers 3, 4 should be sufficiently steep to provide continuous flow of material. For example, a hopper angle in the range of about 20°-60° (and preferably about 30° as shown in FIG. 1) can be used to provide continuous flow of material. Similarly, the angle of the main funnel should be sufficiently steep to provide continuous flow of material. For example and as shown in FIG. 1, the angle of the main funnel 9 in the range of about 30°-60° (and preferably about 40°) can be used to provide continuous flow of material.

As mentioned above, homogenous mixtures can be formed by efficient blending and continuous flow of adsorbents. If any of the flow areas become clogged or plugged even for a short duration, the desired mixing of the adsorbents can be compromised or will not occur since the mixing depends on the dynamic flow and random impact of the adsorbent particles. As also discussed above, to prevent plugging of the main funnel, the flow area out of main funnel A should be larger than the sum of the two flow areas out of each hopper, A>A1+A2. In some embodiments, the main funnel discharge area A can be twice the sum of the hopper discharge areas, (A=2(A1+A2)). In addition, the minimum dimension of each hopper discharge area should be at least six times the average particle size of the material contained within that hopper to prevent plugging of the hopper opening. For example, where the average particle size of the adsorbents is for example 2.1 mm, a 2-inch ID hopper discharge opening size is more than twenty four times the average adsorbent particle size.

In embodiments where more than two materials are to be mixed using more than two bins and hoppers, the area A of the main discharge funnel should be at least equal to the sum of all the areas, (A1+A2+ . . . +An) of the hopper discharge openings of the bins of materials.

In some embodiments, a hose, a distributor or a loading arm may be attached to the downstream of the main funnel opening to better distribute the materials into the vessel. It is equally important to prevent plugging of these attachments since they eventually can plug the main funnel. Accordingly, such attachments should also be sized in such a way that their minimum cross-sectional flow area should be greater than the area of the main funnel discharge opening.

In preferred embodiments, the top of the main funnel 9 is covered (not shown in FIG. 1) to prevent bouncing particles from falling out of the funnel and to prevent exposure to moisture of the adsorbents being mixed. For additional protection, the main funnel, bins, hoppers and vessel can be purged with an inert gas or dry air during mixing and loading the adsorbents to keep moisture from the adsorbent.

In some embodiments, the desired composition is uniform and can be controlled within a small tolerance range (e.g., the composition varies only by about 1% or less by volume (which can be converted to a weight basis)).

In some embodiments of the present invention, the volume of each adsorbent in the mixture can be varied during continuous operation of the mixer. More specifically, the adsorbent mixture composition according to this embodiment of the invention can be varied in any predetermined amount as a function of the desired bed height in the vessel. Such embodiments may be advantageous for example in situations where it is desirable to vary the adsorbent mixture composition along the length of the adsorbent bed.

In accordance with such embodiments of the present invention, the hoppers are equipped with one or more load cells to measure the weight of the bin, hopper and material therein. Valves (e.g., slide valves, control valves, or iris valves that can be used to control the flow of particles) are to be controlled and varied during operation of the mixer to achieve the desired mixture of materials. The valves can optionally be controlled by using a microprocessor (for example, a program logic controller (PLC) or process computer) to monitor load cells and control discharge valves. The microprocessor (e.g., PLC or computer) can thus be connected to one or more load cell(s) on each bin/hopper. For example and while not to be construed as limiting, the PLC or computer can be connected to three load cells per bin/hopper (e.g., positioned proximate to the outer edge of the bin). Alternatively, the PLC or computer can be connected to one load cell per hopper if the hopper is suspended from the load cell. The discharge valves may be controlled manually based on the computer display. In other alternative embodiments, the PLC or computer can be programmed to control or respond to load cell measurement(s). For example, the PLC or computer can be programmed to determine the change in weight of the material in the hoppers using feedback (continuous or intermittent) from the load cells that measure the weight of the bin, hopper and weight of the material therein. In response to such feedback, the particle valves (e.g., iris valves) can be opened or closed to respectively increase or decrease the volume of adsorbent being discharged from the respective discharge hopper. In this manner, a continuous variable mixture of materials (e.g., adsorbents) over the height of the material (e.g., adsorbent) bed in the vessel can be provided if desired.

Such embodiments can also be used to form discrete uniform layers of mixtures of materials in the vessel. For example, such embodiments can also be used to form discrete layers of mixtures of materials in the vessel such as those disclosed in copending, commonly assigned U.S. patent application Ser. No. 11/799,197, filed on even date herewith (May 1 2007), to Rege, et. al., and entitled "Adsorbents for Pressure Swing Adsorption Systems and Methods of Use Therefor", the contents of which are hereby incorporated herein by reference.

It is recommended that the hopper system be properly electrically grounded to earth in order to avoid a build-up of static electricity during the discharge of dry adsorbents. Creation of static energy can interfere with the functioning of the load cells or electrical connections and may be a safety hazard.

The volume of the hoppers used above are preferably sized to accommodate the entire inventory of adsorbents required to be loaded in the vessel. However, if the amount of mixed adsorbent to be loaded into the vessel is large, it may be more cost effective to design a smaller volume for the hoppers and periodically replenish these during the loading process before the adsorbent inventory contained therein is completely discharged.

Figure 2:
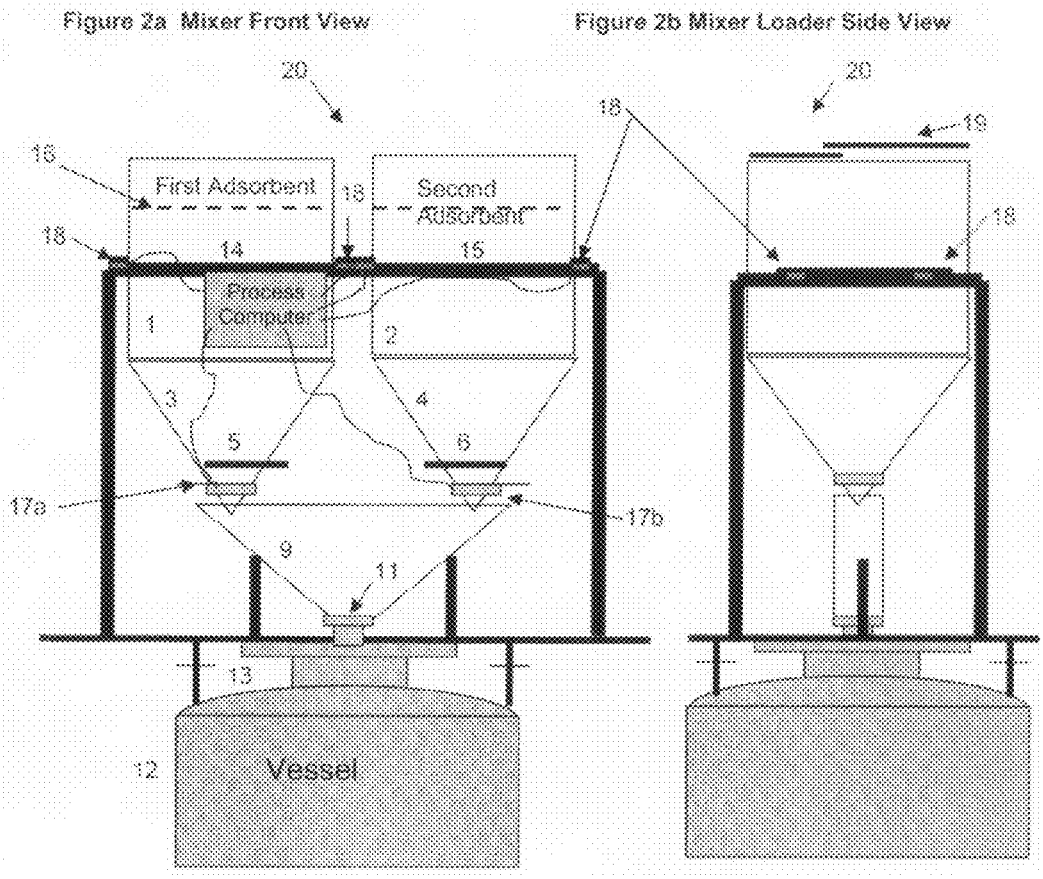
FIG. 2*a* illustrates another embodiment of a mixer suitable for use in accordance with the present invention.
FIG. 2*b* is a side view of FIG. 2*a;*

Referring now to FIGS. 2*a* and 2*b*, a front view and a side view of an alternative mixer in accordance with the present invention is shown. Mixer 20 includes bins 1, 2 as well as hoppers 3, 4 as discussed hereinabove with reference to FIG. 1. Main funnel 9 is positioned proximate to nozzle neck 13 of the vessel.

In use, mixer 20 can further include first material 14 housed in bin 1 and second material 15 housed in bin 15. A course mesh screen 16 can be placed at the top of each hopper to remove large material which may be in the drum of adsorbent or to catch objects which are dropped into the hopper during the loading operation. As shown in FIG. 2*b*, the top of each bin can include a sliding top(s) 19.

As shown in FIG. 2*a*, control valves 17*a* and 17*b* can be implemented at the bottom of each hopper to allow the flow rate of the adsorbent material being discharged from the respective bins 1, 2 to be varied. Such valves can be manual control or automatic control valves. For example, automatic control valves can include iris valves, sliding valves or the like. This results in a mixture which can be varied as a function of the amount of material discharged from the hoppers. In some embodiments such as shown in FIG. 2*a*, gate valves 5, 6 can be included as on/off valve(s) to initiate or shutoff flow.

The bins/hoppers in this embodiment are equipped with one or more load cells to measure the respective weight of the bin, hopper and material therein. More specifically, the weights of the bins, hoppers and materials contained therein can be determined by one or more electronic load cells 18 connected to a microprocessor (e.g., PLC or computer) as shown in FIG. 2*a*. In some such embodiments, each bin/hopper can have three load cells connected to the microprocessor (e.g., PLC or computer). The outputs of the load cell(s) are connected to the microprocessor (e.g., PLC or computer) which can control the hopper outlet valves.

In accordance with the mixing method and as discussed above with reference to FIG. 1, each material (e.g., adsorbent) discharges from the at least two bins through the hoppers onto the main funnel that sits on top of the vessel nozzle. As the materials (e.g., adsorbents) discharge through the hoppers the materials impact to the inner surface of the funnel, bounce towards the center axis of the funnel and randomly mix with the other adsorbent to form a homogeneous mixture. The blended mixture of adsorbents then chutes down from the main funnel opening into the process vessel.

The volume percentage of each adsorbent material in the mixture is controlled by the flow area of discharge hopper, which is regulated by slide-gates, iris or other particle control valves. The particle valves can be controlled by means of a microprocessor (e.g., PLC or process computer) measuring the weight change of the adsorbent bin/hoppers and material therein by means of load cells on each of the adsorbent hoppers as shown in FIGS. 2*a* and 2*b*. The measurements are converted to give a flow rate of material being discharged from each hopper. The composition of the mixture is determined by equation (1):

$$\text{Mixture } A \text{ Weight } \% = \frac{\text{Hopper } A \text{ Discharge (lb/min)}}{\text{Total Discharge from Hoppers } A \text{ and } B\text{(lb/min)}} \times 100$$

The desired adsorbent mixture can be programmed through the process controller (PLC or computer) to produce either a uniform mixture or a mixture which will vary.

In addition to being able to homogeneously vary the composition as a function of bed height, the embodiment of the present invention allows one to manually or automatically adjust the flowrate(s) to accommodate changes in flow characteristics, particle size, density or other parameters.

Figure 3:
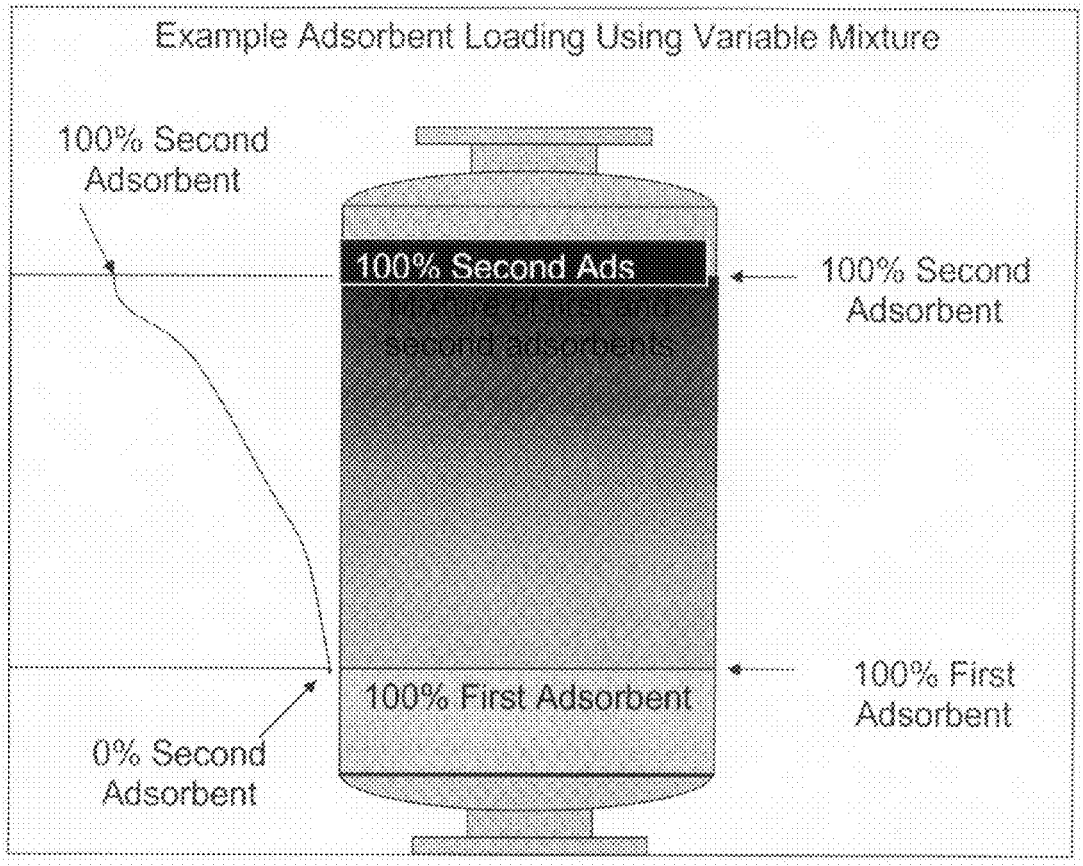
FIG. 3 shows an exemplary loading configuration using a variable mixture composition.

FIG. 3 illustrates an exemplary loading configuration utilizing the mixer shown in FIGS. 2*a* and 2*b*. As can be seen, the bed of material in the vessel ranges from 100% of the first adsorbent to 100% of the second adsorbent. The mixture of the first and second adsorbents can be varied continuously along the length of the bed.

As discussed hereinabove, the mixers of the present invention can be used to simultaneously mix different types of adsorbents and load the mixture into a vessel. As mentioned above adsorbents may be of the types defined as zeolites, molecular sieves, activated alumina, silica gel, activated carbon, etc. The invention, however, is not restricted to mixing two adsorbents. Various combinations of adsorbents, catalysts and inert solids may be mixed. It is within the scope of the invention to use more than two hoppers to simultaneously mix and load more than two adsorbents or any number of adsorbents or materials. For example and while not to be construed as limiting, three or four hoppers could be used to simultaneously mix and load three or four different adsorbents. The mixer aspects discussed above in connection with FIGS. 2 and 3 could also be used with each hopper.

In addition, while much of the discussion above has been exemplified with two different adsorbents to create a mixture of 50%-50% by volume, the invention is not limited to such volume percent of mixtures. By adjusting the discharge flow area and accordingly the flow rate out of one or both hoppers, any volume percentage ratio can be achieved. Moreover, any volume percentage of any number of adsorbents can likewise be achieved. Rather than fully opening the slide-gates to achieve different volumetric flow rates out of both hoppers, one of the slide-gates can be partially opened to throttle the flow to achieve volume mixtures other than 50%-50%. Additionally, the discharge of the hoppers can also be furnished with slide-gates of varying opening sizes or an iris valve to provide more flexibility to alter the volumetric discharge flow rates.

It is further possible to specify percentage of mixture by weight by converting the volume ratio into weight ratio by multiplying the density of individual components to its volume percentages.

The mixers of the present invention can be used with any shape, size and density of adsorbents, as long as the volumetric flow rate out of each hopper is set properly to achieve desired material composition in the mixture.

Various types of cross-sectional shapes can be used for the bins and hoppers in the invention. For example and for purposes of illustration, circular, rectangular or a combination of rectangular and circular cross-sectional areas could be used in the invention. A cylinder could also be partitioned into one or more bins using internal wall(s) with hoppers for each bin. Likewise, a rectangular cross-section could be partitioned into at least two bins using internal wall(s) with hoppers for each bin. More specifically, cylindrical bins could be replaced with rectangular bins, and instead of a conical hopper, pyramidal, planar, or transitional (a combination of pyramid and cone) could be implemented in accordance with the present invention. In yet other embodiments, a rectangular funnel could be used instead of a conical funnel. In addition, hoppers can have multiple hopper angles on different sides (preferably with the hoppers identical to each other).

As long as materials are impacting in symmetrical locations on the main funnel, the axis of the bins and hoppers need not be parallel with the axis of the main funnel. In addition, the hoppers need not be the same size or shape. Moreover, multi-stage bin/hopper/funnel arrangements are contemplated and within the scope of the invention, and may particularly be useful for mixing three or more materials.

Upon discharge from bins and hoppers, materials can be carried through chutes, pipes, conveyors or the like onto the main funnel. Likewise, the adsorbent mixture dispensed from the main funnel can be loaded into the vessel by a system of chutes, pipes or rotating arms composed of perforated pipes.

The mixers of the present invention can be used for creating homogeneous mixtures suitable for use in a variety of vessels (e.g., vessels for processes using pressure swing adsorption (PSA), temperature swing adsorption (TSA), vacuum pressure swing adsorption (VPSA) and combinations thereof). The mixers can also be used with other types of reactor vessels. In particular embodiments, the invention can be used for prepurification units upstream of cryogenic air separation units.

EXAMPLE 1

An experimental study was performed using a small scale mixer unit for an arrangement similar to that shown in FIG. 1. The adsorbent materials used were 13X APG (8×12) from UOP, LLC from Des Plaines, Ill. and AgX (10×20). Both adsorbents have spherical-shaped particles. AgX had a density of 1.0 g/cc and an average particle size of 1.4 mm. 13X APG had a density of 0.65 g/cc and an average particle size of 2.1 mm.

Figure 4:
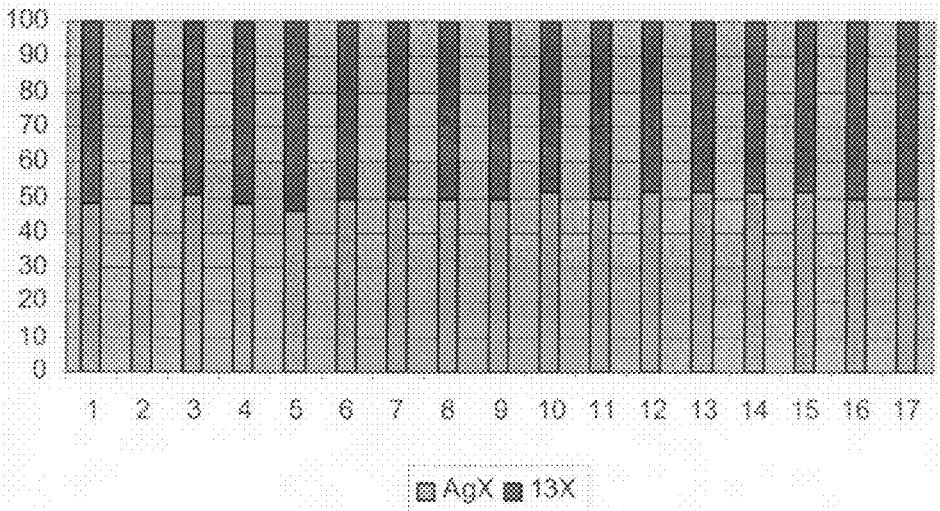
FIG. 4 shows the volume percent of each component in the mixture for an experimental study with a small scale mixer.

The mixer unit was designed for a 50%-50% volume of 13X APG and AgX by sizing the discharge hoppers to produce equal flow rates. The adsorbents were first mixed using the mixer unit and a total of seventeen samples were collected while the mixer was in continuous operation to achieve a desired 50%-50% mixture by volume of the two adsorbent materials. All the samples were collected in equal time intervals. Then, the adsorbents in each of seventeen collected samples were separated and the corresponding volume of each material in the mixture was measured. The results illustrated in FIG. 4 and shown in Table 1 below (volume % of each component in the mixture) revealed that the mixer successfully mixed the two materials very close to the desired volume percentage of 50%-50% from start to finish.

TABLE 1

| Sample # | AgX % | 13X % |
|---|---|---|
| 1 | 48 | 52 |
| 2 | 48 | 52 |
| 3 | 51 | 49 |
| 4 | 48 | 52 |
| 5 | 46 | 54 |
| 6 | 50 | 50 |
| 7 | 50 | 50 |
| 8 | 50 | 50 |
| 9 | 50 | 50 |
| 10 | 52 | 48 |
| 11 | 50 | 50 |
| 12 | 52 | 48 |
| 13 | 52 | 48 |
| 14 | 52 | 48 |
| 15 | 52 | 48 |
| 16 | 50 | 50 |
| 17 | 50 | 50 |

EXAMPLE 2

A field scale bin/hopper combination was fabricated and tested. More specifically, the unit included a cylinder partitioned into two bins and with two conical discharge hoppers. Each bin/hopper had a capacity of about 10 $ft^3$. Each hopper discharge had a 2-inch diameter opening and the main funnel discharge had a 4-inch diameter opening. The distance from the centerline of the main funnel to each centerline of the hopper was 8 inches.

The materials tested had the same characteristics as described in Example 1 above (13X APG and AgX). Each hopper was loaded with about 2-3 $ft^3$ of one of the adsorbent materials.

A total of 11 samples were collected in three mixing runs while the mixer was in operation and continuously mixing the AgX and 13X molecular sieve adsorbent materials to achieve a desired 50%-50% mixture by volume. The adsorbents in each of the 11 collected samples were separated and the corresponding volume of each material in the mixture was measured. The results shown in Table 2 below (volume % of each component in the mixture) revealed that the mixer successfully mixed two materials close to the desired volume percentage of 50%-50% from each of the three runs.

For a 2-inch diameter discharge opening, both materials had the same flow characteristics. It should be noted, however, that the flow characteristics of these materials may not be the same for discharge diameters smaller than 2-inches.

It should be noted that run 1, sample 4 was taken as the bins were running out of material and no longer at steady state rates. The measurements in Table 2 other than run 1, sample 4 showing a larger deviation from the desired mixture composition are believed to be attributable to the difficulty in manually sampling the mixture from the high flow rate from the main funnel.

TABLE 2

| Run # | Sample # | AgX % | 13X % |
|---|---|---|---|
| 1 | 1 | 48 | 52 |
| 1 | 2 | 50 | 50 |
| 1 | 3 | 43 | 57 |
| 1 | 4 | 21 | 69 |
| 2 | 1 | 58 | 42 |
| 2 | 2 | 40 | 60 |
| 2 | 3 | 38 | 62 |
| 2 | 4 | 50 | 50 |
| 3 | 1 | 50 | 50 |
| 3 | 2 | 48 | 52 |
| 3 | 3 | 50 | 50 |

EXAMPLE 3

An experimental study was performed using a small scale mixer unit arrangement similar to that shown in FIG. 1. The adsorbent materials used were 13X APG (8×12) and D-201 alumina (7×12), both from UOP, LLC from Des Plaines, Ill. Both adsorbents are spherical-shaped particles.

The mixer unit was designed to make different weight percent mixtures for testing in the PSA pilot plant. The desired ratio for mixtures 1-3 was 45 weight percent 13X APG and 55 weight percent D-201 alumina. The desired ratio for mixtures 4-5 was 33⅓ weight percent 13X APG and 66⅔ weight percent D-201 alumina. The adsorbent mixtures were made using the mixer unit with various hole sizes to achieve different weight percent mixtures of the two adsorbent materials. The results were obtained by weighing the material which passed through each of the hoppers. The results are shown in Table 3 below.

TABLE 3

| | D-201 | | 13X | | 13X Ratio |
|---|---|---|---|---|---|
| | Hole Dia Inch | Weight lbs | Hole Size | Weight lbs | (weight %) |
| Mix 1 | 0.425 | 12.94 | 0.425 | 10.572 | 44.96% |
| Mix 2 | 0.375 | 13.72 | 0.345 | 10.44 | 43.20% |
| Mix 3 | 0.425 | 4.051 | 0.394 | 10.05 | 47.40% |
| Mix 4 | 0.456 | 25.73 | 0.435 | 12.72 | 33.10% |
| Mix 5 | 0.456 | 11.87 | 0.435 | 5.89 | 33.20% |

EXAMPLE 4

A field-size scale mixer similar to the schematic of FIG. 2*a* and 2*b* was fabricated and tested. The bins/hoppers each had a rectangular cross-sectional area and each bin/hopper had a capacity of about 22 $ft^3$. The mixer included three load cells per bin/hopper, a process computer to measure the weight change in the respective bin/hopper and material therein and hence the flow rate of material out of each hopper. The load cells were GSE Model 7300 lever tankmount weigh modules having 1000 lb capacity and the microprocessor was programmable digital weight indicator, GSE Model 665, both available from SPX GSE Systems, Inc., of Novi, Mich. The weight ratio was then calculated on a continuous basis.

The iris control valves were manual adjustment type valves. In addition, the mixer included a slide-gate valve on each hopper. The slide-gate valves were not used, but were left in the open position. While the discharges from the hoppers were not on the center line of the respective bins, the impact from the hopper discharge openings were in accordance with the concepts discussed above (i.e., symmetrical impact within the main funnel).

Figure 5:
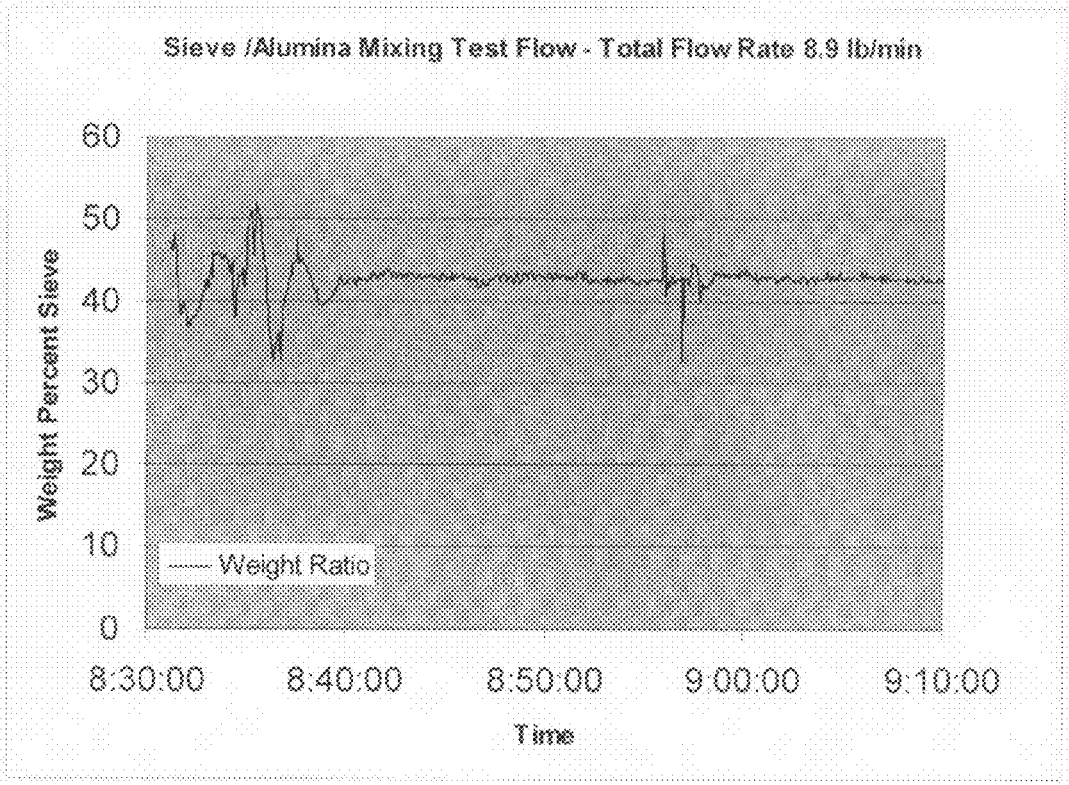
FIG. 5 is a graph of weight percentage sieve vs. time for Example 4.

The mixer was tested in the lab using 13X APG (8×12) molecular sieve and D-201 alumina (7×12), both available from UOP, LLC from Des Plaines, Ill. FIG. 5 shows the results of a 40 minute mixing run at a total flow rate of 8.9 lb/min discharging from the main funnel. The first 5 minutes show the mixture response to small manual valve changes. After that time, the valve settings were kept constant and the mixture composition was constant at the desired 43 weight percent of 13X APG and 57 weight percent alumina. The variation at 55 minutes was due to deliberate bumping of the hoppers to observe the response of the load cells and process computer. The system delivered a constant mixture over the test time.

EXAMPLE 5

Figure 6:
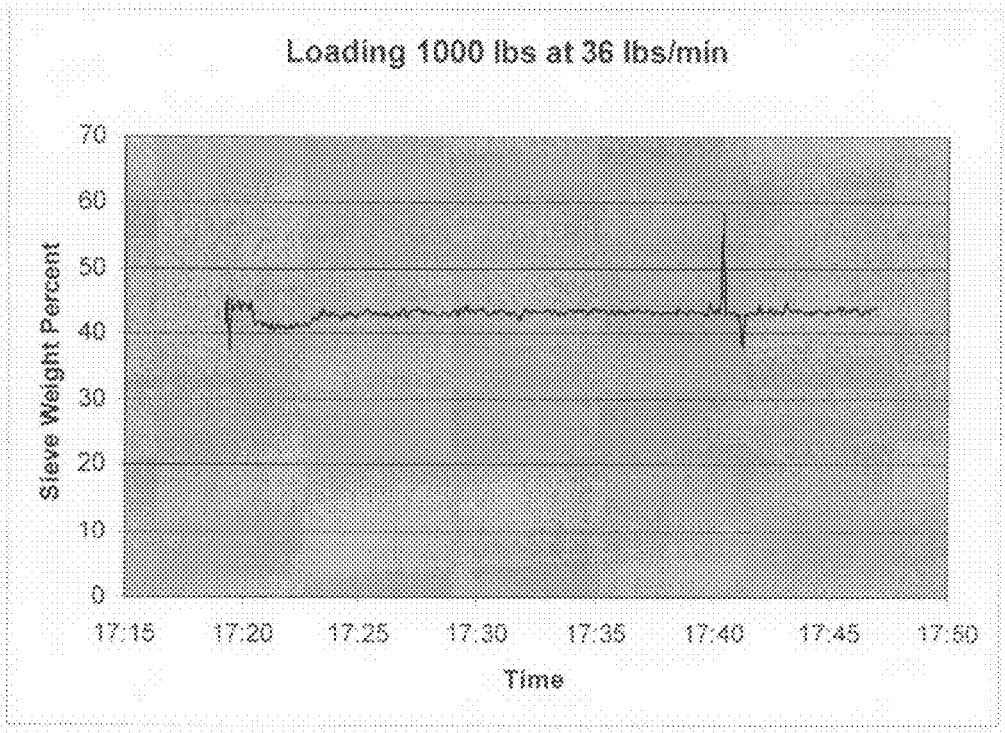
FIG. 6 is a graph of weight percentage sieve vs. time for Example 5.

The field size mixer of example 4 was used in a field test of the mixing system. The mixer was tested in a PSA air prepurification unit to load a mixture of 13X APG (8×12) molecular sieve and D-201 alumina (7×12) as described above in Example 4. The desired mixture was 43 weight percent of 13X APG and 57 weight percent alumina. FIG. 6 shows the results of a 25 minute mixture loading of 1000 pounds at 36 lbs/minute discharging from the main funnel. During the first 4 minutes, the valves were manually adjusted to establish a steady state mixture of 43 weight percent 13X APG and 57 weight percent alumina. After that time, the manual value settings were kept constant and the mixture composition was constant at the desired 43 percent 13X APG and 57 percent alumina. The variation at 17:40 minutes was due to intentional bumping of the hoppers to observe the response of the computer and load cells. The system delivered a constant mixture over the loading time.

It should be appreciated by those skilled in the art that the specific embodiments disclosed above may be readily utilized as a basis for modifying or designing other structures for carrying out the same purposes of the present invention. It should also be realized by those skilled in the art that such equivalent constructions do not depart from the spirit and scope of the invention as set forth in the appended claims.

What is claimed is:

1. A method of mixing at least two solid materials in the form of free flowing particles, the method comprising:

discharging a first material from a first discharge hopper onto an inner surface of a main funnel such that substantially all of the first discharged material directly impacts the inner surface of the main funnel within a first predetermined distance from a central axis of the main funnel;

discharging at least one second material from at least one second discharge hopper onto the inner surface of the main funnel such that substantial all of the at the least one second discharged material directly impacts the inner surface of the main funnel within a second predetermined distance from the central axis of the main funnel;

wherein upon impact on the inner surface of the main funnel, the at least first and second materials bounce from the inner surface of the main funnel to form a homogeneous mixture [with one another] and the volume percentage of the at least first and second materials in the mixture is controlled by the flow area of each of the discharge hoppers to obtain a predetermined composition.

2. The method of claim 1, further comprising introducing the mixture into a vessel.

3. The method of claim 2, wherein the mixture is introduced into the vessel such that at least one bed layer is formed of the mixture of the first and the at least one second materials.

4. The method of claim 3, wherein the vessel is an adsorber or reactor.

5. The method of claim 4, wherein the vessel is an air prepurification vessel positioned upstream of a cryogenic air separation unit.

6. The method of claim 1, wherein the first and second discharge hoppers are arranged such that discharge hopper angles as measured from a vertical reference are each within the range of about 20°-60°.

7. The method of claim 6, wherein the discharge hopper angles are each about 30°.

8. The method of claim 1, wherein the angle of the main funnel is such that a main discharge funnel angle as measured from a vertical reference is within the range of about 30°-60°.

9. The method of claim 8, wherein the angle of the main funnel is about 40°.

10. The method of claim 1, wherein the main funnel has a discharge flow area greater than the sum of the areas of the discharge hoppers discharging into the main funnel.

11. The method of claim 1, wherein the smallest dimension of the first and at least one second hopper discharge area is at least six times the average particle size of the respective first and at least one second materials contained in the respective hopper.

12. The method of claim 1, wherein the first and second materials are selected from the group consisting of adsorbents, catalysts, inert materials and combinations thereof.

13. The method of claim 12, wherein the first and second materials are adsorbents selected from the group consisting of zeolites, activated alumina, activated carbon, and silica gel.

14. The method of claim 1, wherein the points of impact of the first and at least one second material on the inner surface of the main funnel are spaced symmetrically relative to the central axis of the main funnel.

15. The method of claim 1, further comprising:

discharging a third material from a third discharge hopper onto the inner surface of the main funnel such that the first, second and third materials impact the inner surface of the main funnel symmetrically relative to the central axis of the main funnel;

wherein upon impact on the inner surface of the main funnel, the first, second and third materials bounce from the inner surface of the main funnel and form a homogeneous mixture with one another.

16. A method of mixing at least two solid materials in the form of free flowing particles, the method comprising:

discharging a first material from a first discharge hopper onto an inner surface of a main funnel such that substantially all of the first discharged material directly impacts the inner surface of the main funnel within a first predetermined distance from a central axis of the main funnel;

discharging at least one second material from at least one second discharge hopper onto the inner surface of the main funnel such that substantially all of the at the least one second discharged material directly impacts the inner surface of the main funnel within a second predetermined distance from the central axis of the main funnel;

wherein upon impact on the inner surface of the main funnel, the at least first and second materials bounce from the inner surface of the main funnel and form a homogeneous mixture with one another; and wherein the discharging of the first and second materials can be continuously adjusted based on feedback from a microprocessor to form a homogenous mixture having a variation of the first and second materials in the mixture is less than 10%.

17. The method of claim 16, further comprising introducing the mixture into a vessel.

18. The method of claim 17, wherein the mixture is introduced into the vessel such that at least one bed layer is formed of the mixture of the first and second materials.

19. The method of claim 18, wherein the vessel is an adsorber or reactor.

20. The method of claim 19, wherein the vessel is an air prepurification vessel positioned upstream of a cryogenic air separation unit.

21. The method of claim 16, wherein the first and second discharge hoppers are arranged such that discharge hopper angles as measured from a vertical reference are each within the range of about 20°-60°.

22. The method of claim 21, wherein the discharge hopper angles are each about 30°.

23. The method of claim 16, wherein the hopper angle of the main funnel is such that a main discharge funnel angle as measured from a vertical reference is within the range of about 30°-60°.

24. The method of claim 23, wherein the hopper angle of the main funnel is about 40°.

25. The method of claim 16, wherein the main funnel has a discharge flow area greater than the sum of the areas of the discharge hoppers discharging into the main funnel.

26. The method of claim 16, wherein the smallest dimension of the first and at least one second hopper discharge area is at least six times the average particle size of the respective first and at least one second material contained in the respective hopper.

27. The method of claim 16, wherein the first and second materials are selected from the group consisting of adsorbents, catalysts, inert materials and combinations thereof.

28. The method of claim 27, wherein the first and second materials are adsorbents selected from the group consisting of zeolites, activated alumina, activated carbon, and silica gel.

* * * * *

UNITED STATES PATENT AND TRADEMARK OFFICE

CERTIFICATE OF CORRECTION

PATENT NO. : 8,573,831 B2
APPLICATION NO. : 11/799198
DATED : November 5, 2013
INVENTOR(S) : Celik et al.

It is certified that error appears in the above-identified patent and that said Letters Patent is hereby corrected as shown below:

In the Claims:

In claim 1, Column 14, line 55, the word "substantial" should read "substantially".

In claim 1, Column 14, line 63, "[with one another]" should be removed.

Claim 1 should read as follows:

1. A method of mixing at least two solid materials in the form of free flowing particles, the method comprising:

discharging a first material from a first discharge hopper onto an inner surface of a main funnel such that substantially all of the first discharged material directly impacts the inner surface of the main funnel within a first predetermined distance from a central axis of the main funnel;

discharging at least one second material from at least one second discharge hopper onto the inner surface of the main funnel such that substantially all of the at the least one second discharged material directly impacts the inner surface of the main funnel within a second predetermined distance from the central axis of the main funnel;

wherein upon impact on the inner surface of the main funnel, the at least first and second materials bounce from the inner surface of the main funnel to form a homogeneous mixture and the volume percentage of the at least first and second materials in the mixture is controlled by the flow area of each of the discharge hoppers to obtain a predetermined composition.

Signed and Sealed this
Twenty-fifth Day of February, 2014

Michelle K. Lee

Michelle K. Lee
*Deputy Director of the United States Patent and Trademark Office*